US007793758B2

(12) United States Patent
Rimback

(10) Patent No.: US 7,793,758 B2
(45) Date of Patent: Sep. 14, 2010

(54) TRIANGULAR CROSS SECTION EXHAUST MUFFLER

(76) Inventor: Grant Robert Rimback, 125 Littlebrook Cr, Rockford, TN (US) 37853

( * ) Notice: Subject to any disclaimer, the term of this patent is extended or adjusted under 35 U.S.C. 154(b) by 0 days.

(21) Appl. No.: 12/313,203

(22) Filed: Nov. 19, 2008

(65) Prior Publication Data

US 2009/0127025 A1 May 21, 2009

Related U.S. Application Data

(60) Provisional application No. 61/003,510, filed on Nov. 19, 2007.

(51) Int. Cl.
*F01N 13/08* (2010.01)

(52) U.S. Cl. ..... 181/282; 181/247; 181/264; 181/267

(58) Field of Classification Search ..... 181/232, 181/264, 270, 282, 227, 228, 247
See application file for complete search history.

(56) References Cited

U.S. PATENT DOCUMENTS

| | | | | | |
|---|---|---|---|---|---|
| 624,062 | A | * | 5/1899 | Mattews | 181/264 |
| 1,085,203 | A | * | 1/1914 | Gipple | 181/281 |
| 1,182,611 | A | * | 5/1916 | Williams | 181/281 |
| 1,229,471 | A | * | 6/1917 | Jones | 181/264 |
| 1,804,070 | A | * | 5/1931 | Sykes | 181/264 |
| 2,046,193 | A | * | 6/1936 | Spicer | 181/252 |
| 2,202,272 | A | * | 5/1940 | Smith | 181/270 |
| 2,392,247 | A | * | 1/1946 | Katcher | 181/270 |
| 2,485,555 | A | * | 10/1949 | Bester | 181/260 |
| 2,727,584 | A | * | 12/1955 | Marx | 181/270 |
| 2,896,743 | A | * | 7/1959 | Bradshaw | 55/308 |
| 2,946,325 | A | * | 7/1960 | Gentile | 60/278 |
| 3,092,206 | A | * | 6/1963 | Moreau | 181/270 |
| 3,495,680 | A | * | 2/1970 | Willette | 181/232 |
| 3,559,760 | A | * | 2/1971 | Ninomiya | 181/231 |
| 3,747,347 | A | * | 7/1973 | Ciraolo | 60/309 |
| 3,966,015 | A | * | 6/1976 | Bychinsky | 181/268 |
| 3,981,378 | A | * | 9/1976 | Potter | 181/230 |
| 3,994,364 | A | * | 11/1976 | Nicoll | 181/238 |
| 4,574,914 | A | * | 3/1986 | Flugger | 181/268 |
| 4,809,812 | A | * | 3/1989 | Flugger | 181/268 |
| 5,123,502 | A | * | 6/1992 | Flugger | 181/264 |
| 5,304,749 | A | * | 4/1994 | Crandell | 181/264 |
| 5,444,197 | A | * | 8/1995 | Flugger | 181/264 |
| 5,739,484 | A | * | 4/1998 | Jones | 181/264 |
| 5,894,115 | A | * | 4/1999 | Weiner | 181/272 |
| 5,936,210 | A | * | 8/1999 | Borneby et al. | 181/264 |
| 6,050,363 | A | * | 4/2000 | Tu | 181/264 |

(Continued)

*Primary Examiner*—Jeffrey Donels
*Assistant Examiner*—Jeremy Luks
(74) *Attorney, Agent, or Firm*—Charles Bickoff

(57) ABSTRACT

The present invention is for a triangular cross section symmetrical engine exhaust muffler for an internal combustion engine. Its internal design provides baffles symmetrically disposed about a plane centrally located equidistant from the ends of a tube having a triangular cross section. The design has three baffles spaced to minimize backpressure but angled to enhance acoustic reflections within the chamber formed by the tube having a triangular cross section, baffles, and the affixed endplates including the inlet/exhaust ports. These acoustic reflections serve to modify the sound emanating from the exhaust manifold or manifolds of the internal combustion engine. The muffler chamber also serves to smooth out the pulsating gas flow emanating from the engine as a result of the combustion cycle.

10 Claims, 7 Drawing Sheets

U.S. PATENT DOCUMENTS 6,089,347 A * 7/2000 Flugger ..... 181/264
6,283,246 B1 * 9/2001 Nishikawa ..... 181/255
6,286,623 B1 * 9/2001 Shaya ..... 181/264
6,364,054 B1 * 4/2002 Bubulka et al. ..... 181/264
6,959,782 B2 * 11/2005 Brower et al. ..... 181/272
7,104,359 B1 * 9/2006 Zelinski ..... 181/264
7,219,764 B1 * 5/2007 Forbes ..... 181/270

* cited by examiner

TRIANGULAR CROSS SECTION EXHAUST MUFFLER

CROSS-REFERENCES TO RELATED APPLICATIONS

This application arises from and claims priority from Provisional Patent Applications 61/003,510 for TRIANGULAR CROSS SECTION EXHAUST MUFFLER filed on Nov. 19, 2007.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to mufflers for internal combustion engines, in particular mufflers for performance vehicles where high backpressure within the muffler is undesirable.

2. Prior Art

The purpose of the muffler is to suppress or modulate the sound emanating from the exhaust ports of an internal combustion. The noise suppression method employed must be geared to minimize the backpressure reflected toward the engine to assure that efficient operation of the engine is assured.

In order to suppress engine exhaust noise, mufflers are connected to the engine exhaust manifold to handle the gaseous byproduct of the engine combustion cycle. These exhaust gases and sounds associated with fuel combustion are ported to the muffler. It is common to suppress this acoustic energy through the use of sharp turns, sharp edges, packings, baffles, and perforated or non-perforated tubing. The goal, while attenuating this acoustic energy, is to minimize the resistance to flow of the gases through the muffler, thereby resulting in lower backpressure reflected to the engine. Most of the prior art inventions are tuned to unidirectional flow wherein there are specific input and output ports to effectively attenuate or tune the sound emanating from the exhaust. These prior art mufflers are unidirectional in that they will function properly only when the gases enter a pre-designated entrance end of the muffler wherein there is a preferred backpressure direction. If the exit port of the muffler is connected to the exhaust port of the engine, overheating of components within the engine due to excessive backpressure may cause damage.

The present invention resolves these and other issues by presenting a symmetrical configuration in which either end may be connected to the exhaust port of the engine as the backpressure in the preferred embodiment is the same in both directions. Moreover the muffler, being triangular in cross section, is stackable in a compact configuration such that dual mufflers can be individually connected to each exhaust manifold in two manifold engines for more efficient exhaust porting. Additionally, the mufflers in this stacked configuration may be connected in series for additional attenuation if desired.

BRIEF SUMMARY OF THE INVENTION

The invention herein described is for a triangular cross section symmetrical engine exhaust muffler for an internal combustion engine. Its internal design provides baffles symmetrically disposed about a plane centrally located equidistant from the ends of a tube having a triangular cross section. In the preferred mode the design has three baffles spaced to minimize backpressure but angled to enhance acoustic reflections within the chamber formed by the tube having a triangular cross section and the affixed endplates including the inlet/exhaust ports. These acoustic reflections serve to modify the sound emanating from the exhaust manifold or manifolds of the internal combustion engine. The muffler chamber also serves to smooth out the pulsating gas flow emanating from the engine as a result of the combustion cycle.

DETAILED DESCRIPTION OF THE INVENTION

The following description illustrates the invention by way of example, not by way of limitation the principles of the invention. The description will clearly enable one skilled in the art to make and use the invention. It describes embodiments, variations, and adaptations including what I believe to be the best mode.

Figure 1:
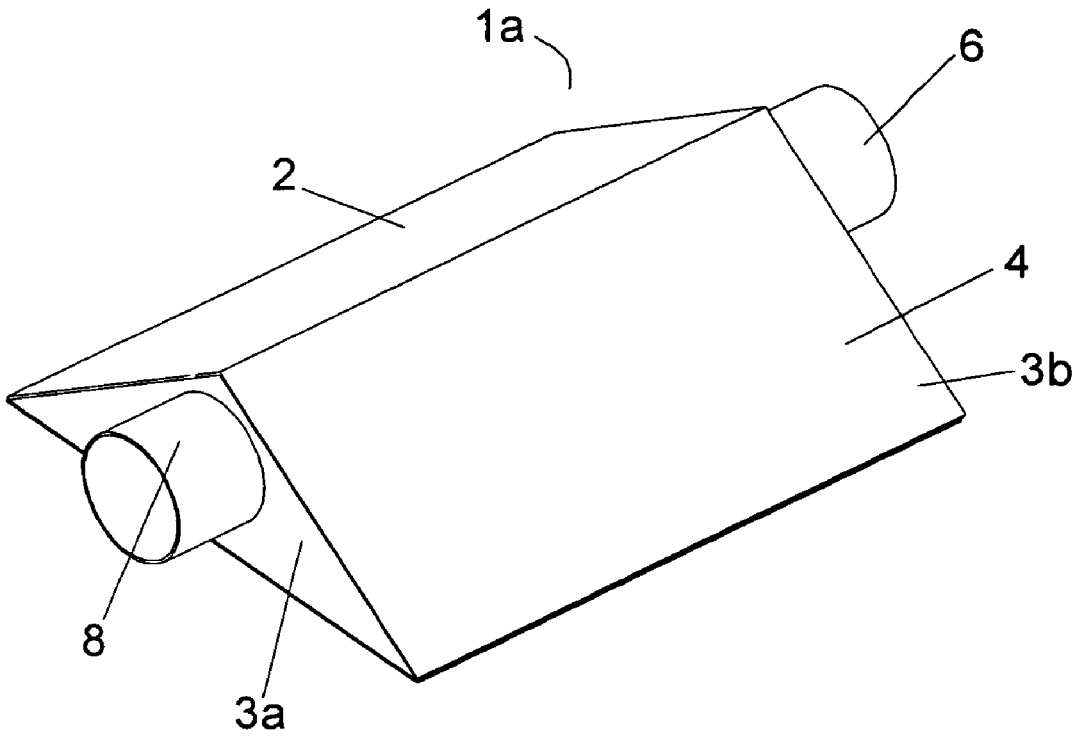
FIG. 1 is a perspective view of one embodiment of the present invention wherein the cross section of the muffler chamber is an isosceles triangle.

FIG. 1 depicts a perspective view of an exhaust muffler 1*a* have a triangular cross section muffler chamber. The exhaust muffler depicted in this embodiment consists of two (2) equal sides 2, first side, and 4, second side, and a base side (third side), 5, not shown in this figure but shown in FIG. 2, two end plates 3*a* and 3*b* interposed respectively with entrance/exhaust ports 6 and 8 which form the muffler chamber. The base side 5 may or may not be equal in length to equal sides 2 and 4. The figure as depicted has an isosceles triangular cross-section, but it will be recognized by those skilled in the art that that any relationship between the sides is possible to practice the invention. In fact, the triangular side relationship may be equilateral, isosceles, acute, or obtuse.

Figure 2:
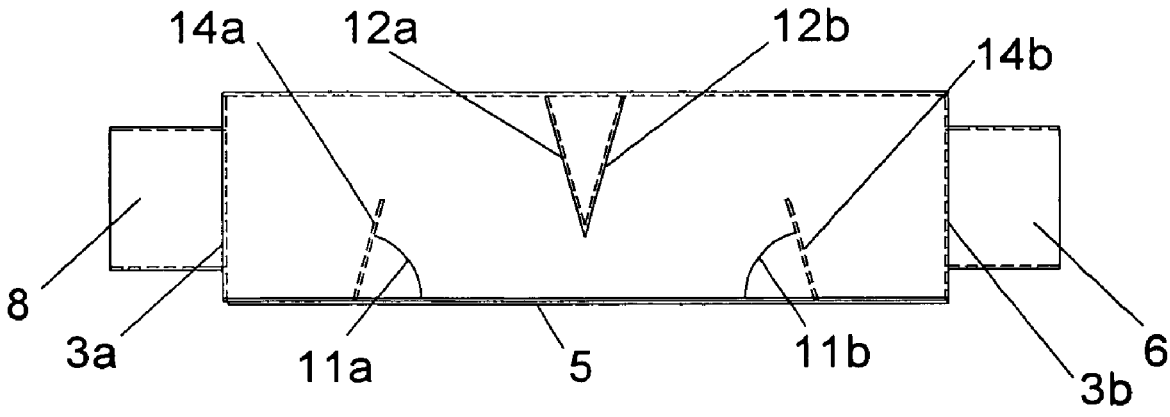
FIG. 2 is a side view of the muffler of FIG. 1 wherein the baffles are shown as hidden lines.

FIG. 2 is a side view of the exhaust muffler shown in FIG. 1 wherein the baffles 12*a*, 12*b*, 14*a*, and 14*b* are shown as hidden features. Also shown is the symmetry of the arrangement of the baffles 12*a*, 12*b*, 14*a*, and 14*b* about the center plane of the muffler chamber. The central baffle is represented by surfaces 12*a* and 12*b* and are angularly disposed and located at a central plane. It should also be noted that the baffles 14*a* and 14*b* overlap baffles 12*a* and 12*b* in the vertical direction thereby eliminating a straight through path when viewed normal to either entrance/exhaust port 6 and 8. Due to the symmetrical design of the present invention, either of the entrance/exhaust ports 6 and 8 may be non-preferentially connected to the exhaust manifold of the engine without concern for increased backpressure. This figure shows 3 baffles, a central baffle having surfaces 12*a* and 12*b* and symmetrically disposed end baffles 14*a* and 14*b*. It will be recognized by those skilled in the art that the number of baffles is not limited to 3 and that the requirement is that the disposition of baffles is that they be symmetrical to yield a bidirectional embodiment. Angles 11*a* and 11*b* show the angle at which the baffles are disposed relative to the base side 5. The angles 11*a* and 11*b* are preferentially tuned in the range of 30 to 65 degrees.

Figure 3:
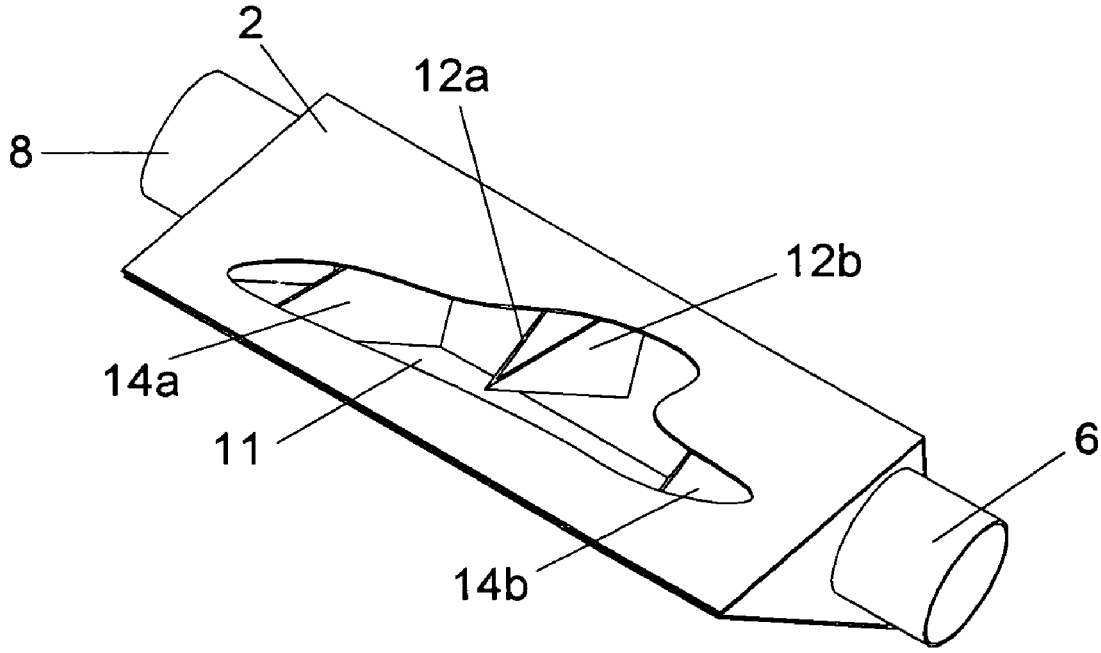
FIG. 3 is a perspective view of the muffler of FIG. 1 wherein a portion of one wall has been removed to further show the baffle arrangement.

FIG. 3 is a perspective view of the exhaust muffler of FIG. 1 wherein a section of equal side 2 has been removed to facilitate observation of the baffle structure in three dimensions. It will be noted that the central baffle surfaces 12*a* and 12*b* are bent to reflect acoustic waves toward the symmetrical baffles 14*a* and 14*b* sides. The acoustic waves continue to be reflected off of the internal surfaces formed by the equal sides 2 and 4, the base side 11, end plates 3*a* and 3*b*, as well as the baffles 14*a* and 14*b* and baffle surfaces 12*a* and 12*b* to attenuate the sound and tune the frequency of the exhaust output.

Figure 4:
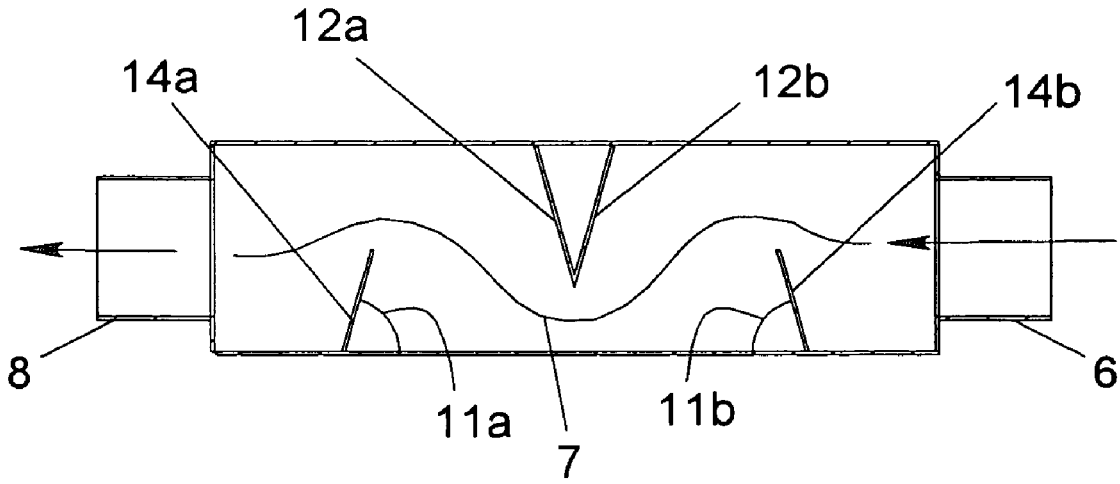
FIG. 4 is a cross section view of the muffler of FIG. 1 to show the baffle arrangement.
Figure 5:
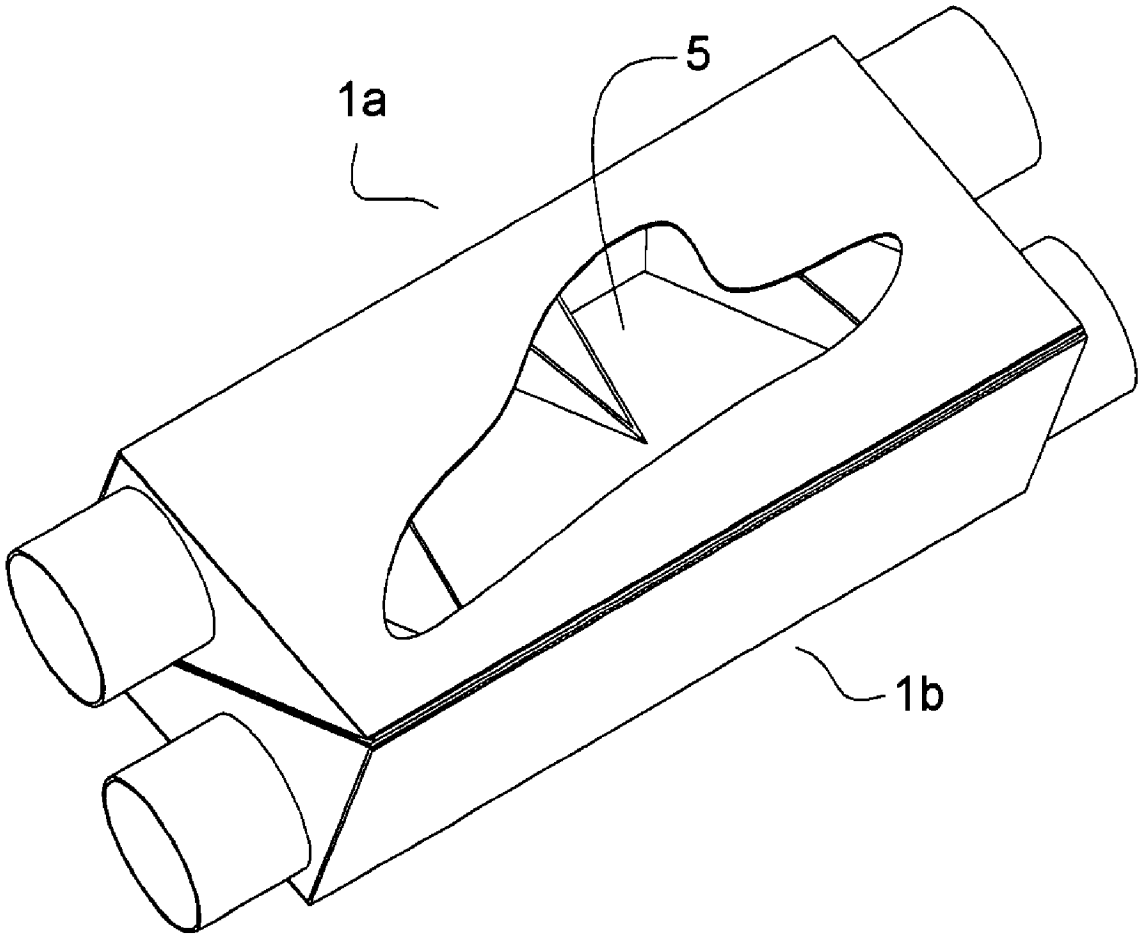
FIG. 5 is a perspective view wherein two mufflers as shown in FIG. 1 are mounted with their bases coincident for use in a compact dual exhaust system.

FIG. 4 is a section view of FIG. 1 wherein the exhaust gas flow 7 can be visualized. Due to the symmetry, it will be recognized that the flow may be non-preferentially reversed, FIG. 5 further shows two exhaust mufflers 1*a* and 1*b* mated on their respective base sides 5. This configuration allows a compact installation of dual exhausts wherein each exhaust muffler 1*a* and 1*b* can be ported to an individual engine exhaust manifold.

Figure 6:
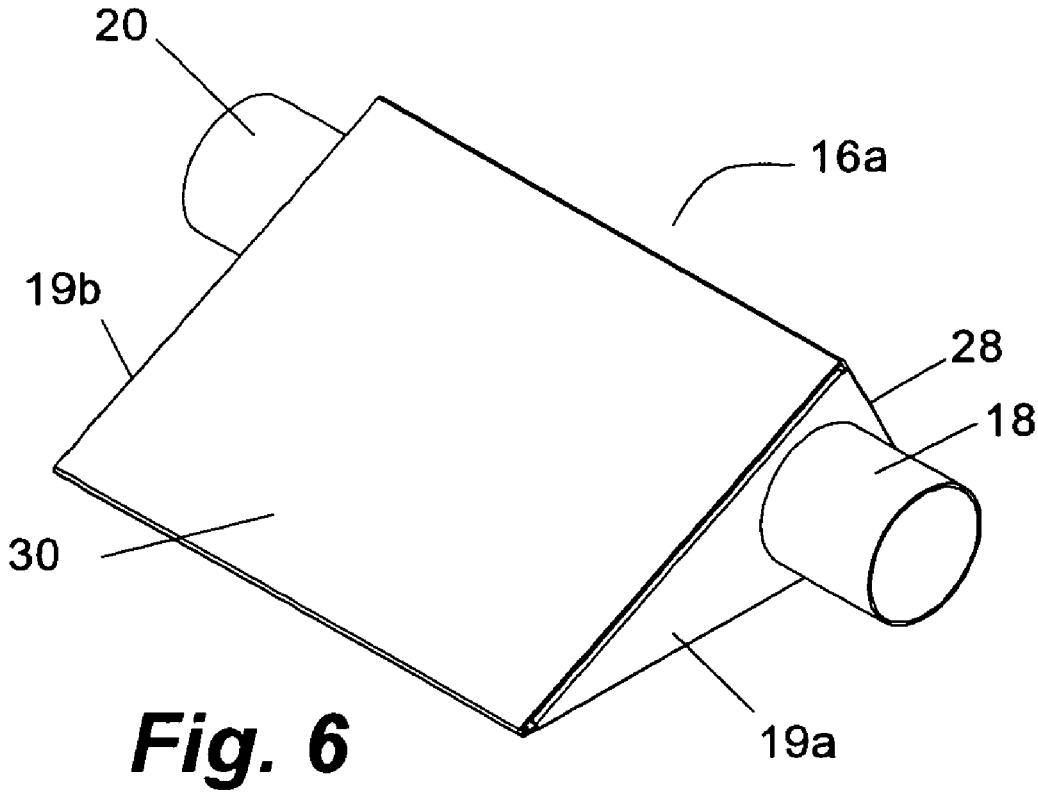
FIG. 6 is a perspective view of a second embodiment of the present invention wherein the cross section of the muffler chamber is a right triangle.

FIG. 6 depicts a perspective view of an exhaust muffler 16*a* having a triangular cross section muffler chamber. The exhaust muffler depicted in this embodiment consists of two (2) right angle sides 30 and 28 of which the edge is shown, and a hypotenuse side 22, shown in FIG. 7, two end plates 19*a* and 19*b* interposed respectively with entrance/exhaust ports 18 and 20 which form the muffler chamber.

Figure 7:
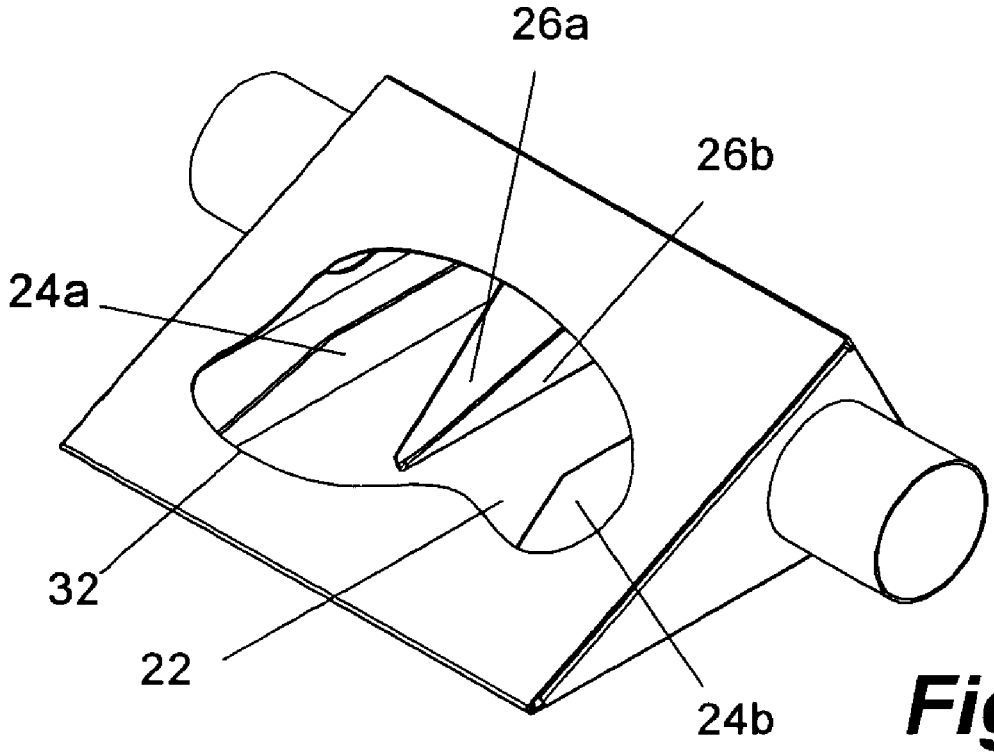
FIG. 7 is a perspective view of the muffler of FIG. 6 wherein a portion of one wall has been removed to further show the baffle arrangement.

FIG. 7 is a perspective view of the exhaust muffler of FIG. 6 wherein a section 32 in right angle base side 22 has been removed to facilitate observation of the baffle structure in three dimensions. It will be noted that the central baffle surfaces 26*a* and 26*b* are angled to reflect acoustic waves toward the end baffles 24*a* and 24*b*. The acoustic waves continue to be reflected off of the internal surfaces formed by the hypotenuse side 22, the base side 30, vertical side 28, end plates 19*a* and 19*b*, as well as the baffle surfaces 24*a* and 24*b* to attenuate the sound and tune the frequency of the exhaust output.

Figure 8:
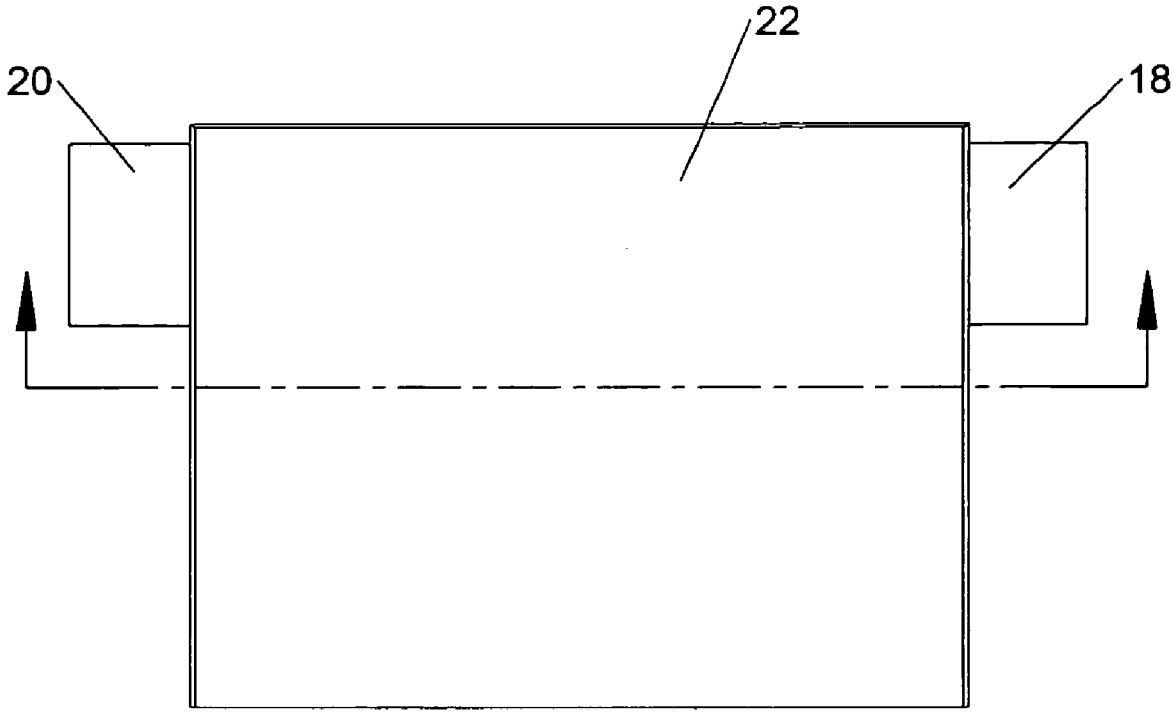
FIG. 8 is a top view of the muffler of FIG. 6.
Figure 9:
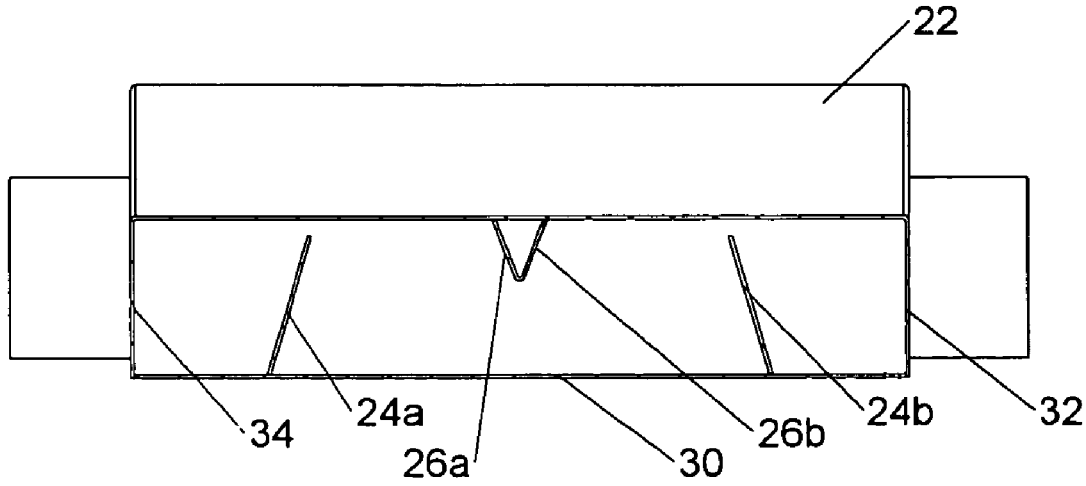
FIG. 9 is a cross section view of the muffler of FIG. 6 to show the baffle arrangement.

FIG. 8 is a top view of the exhaust muffler of FIG. 6 showing the section line wherein FIG. 9 is generated.

FIG. 9 is a section view of FIG. 6 wherein the exhaust gas flow 27 can be visualized.

Figure 10:
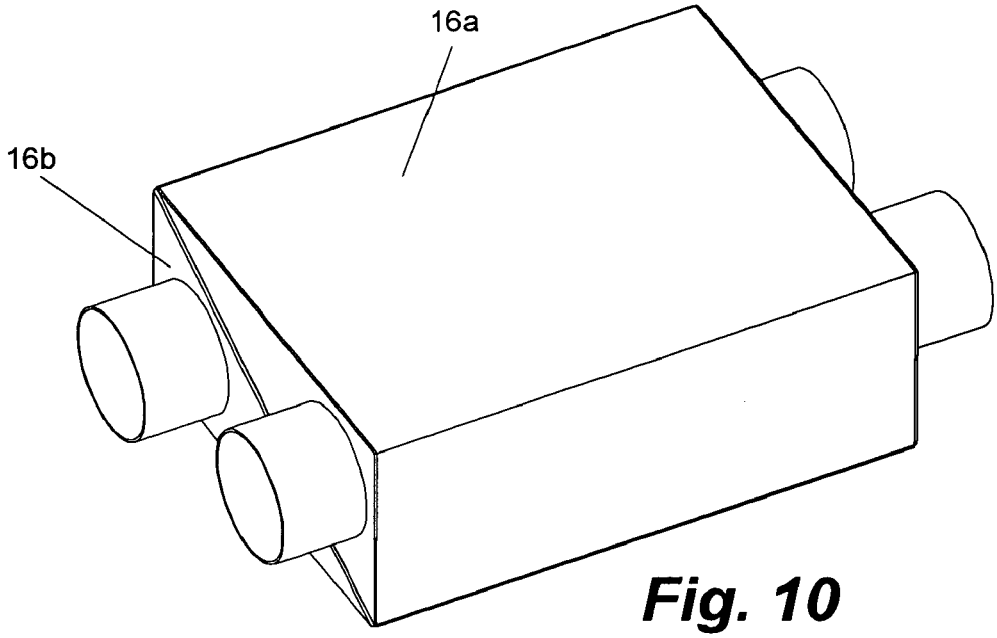
FIG. 10 is a perspective view wherein two mufflers as shown in FIG. 6 are mounted with their bases coincident for use in a compact dual exhaust system.

FIG. 10 further shows two exhaust mufflers mated on their respective hypotenuse sides 22. This configuration allows a compact installation of dual exhausts wherein each exhaust muffler 16*a* and 16*b* can be ported to an individual engine exhaust manifold.

Figure 11:
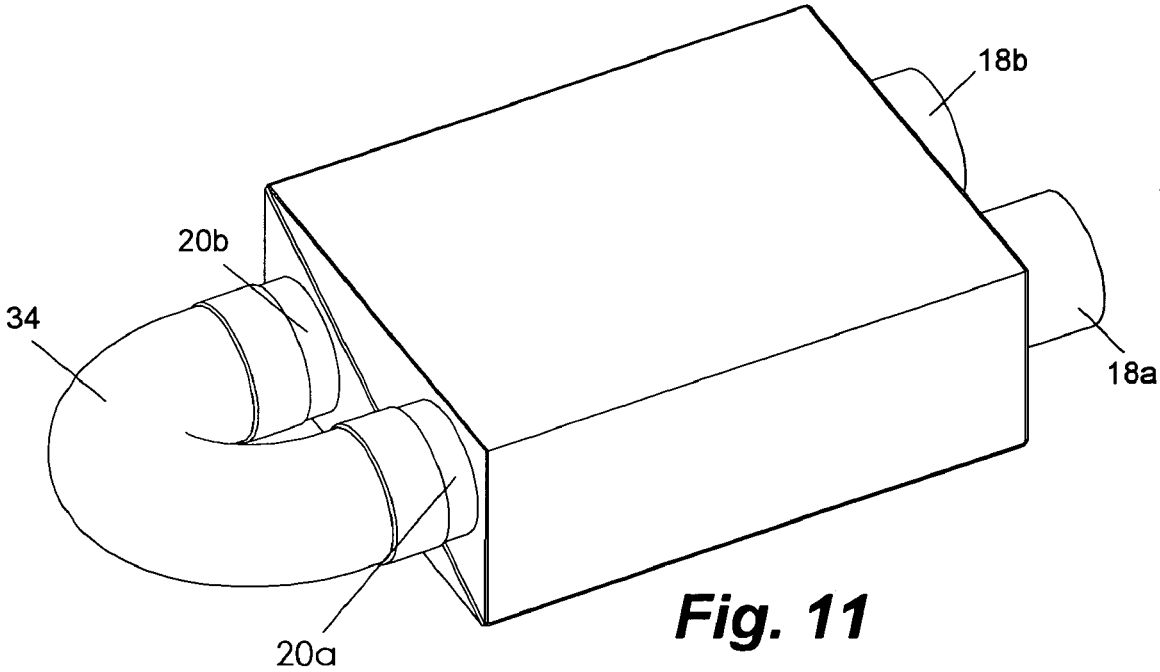
FIG. 11 is a perspective view wherein two mufflers as shown in FIG. 6 are mounted with their bases coincident for use in a compact dual exhaust system and an interconnect pipe is used to connect the two mufflers in series for further attenuation of a single exhaust stream.

FIG. 11 shows two exhaust mufflers mated on their respective hypotenuse sides 22 in the same arrangement as FIG. 10 wherein a series connector pipe 34 connects entrance/exhaust ports 20*a* and 20*b*. This configuration results in a series connection of two exhaust mufflers to allow further attenuation of the acoustic waves while minimizing an increase in backpressure.

Figure 12:
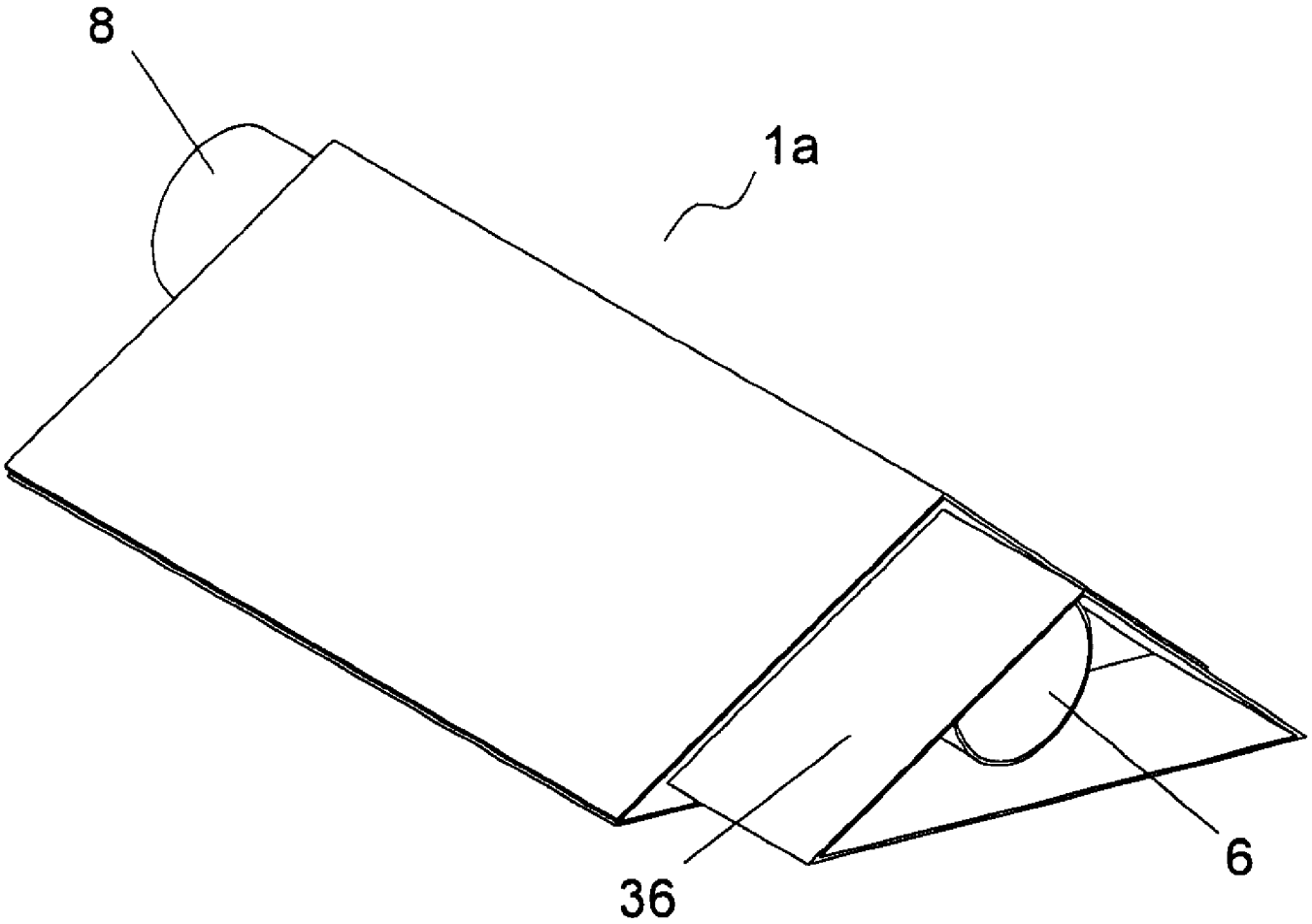
FIG. 12 is a perspective view showing an affixed decorative tail pipe extension.

FIG. 12 shows the exhaust muffler of FIG. 1 wherein a decorative tail pipe extension 36 is added. The decorative tail pipe extension surrounds one of the entrance/exhaust ports 6 and 8. In FIG. 12, entrance/exhaust port 6 has been chosen by way of illustration. This decorative tail pipe extension 36 provides a cosmetic appearance in installations wherein the exhaust muffler is mounted adjacent to the vehicle end or side. The triangular appearance of the decorative tail pipe extension 36 is not limited to a triangular shape and is shown by example.

The present invention is useful in performance-oriented two and four-wheel vehicles where low backpressure for enhanced performance and acoustic attenuation is desired. It will be recognized by those skilled in the art that the triangular cross section is not limited to isosceles, equilateral, or right triangles. It will also be recognized by those skilled in the art that the present invention is not limited to triangular cross section muffler cavities as depicted and that any combination of equal or non-equal sides and included angles are covered by the practice of this invention. It will also be recognized that decorative covers surrounding the outlet port may be attached. The invention may be constructed from a wide variety of materials to include but not be limited to aluminized steel, stainless steel, ceramic-coated steel or aluminum. It also may be decoratively painted with appropriate heat resistant paints.

As will be obvious to persons skilled in the art, various modifications, adaptations, and variations of the specific disclosure can be made without departing from the teaching of the invention.

What is claimed is:

1. An exhaust muffler having a triangular cross section muffler chamber wherein;

said exhaust muffler having a triangular cross section muffler chamber consists of:

a triangular cross section muffler chamber having a first, a second and, a third side;

a pair of end plates;

said end plates each interposed with entrance/exhaust ports wherein said entrance/exhaust ports are interchangeable as one of an entrance port and one of an exhaust port;

a central baffle having two surfaces angularly disposed wherein said central baffle is located on a central plane within the triangular cross section muffler chamber and having its base edges coincident with said first and said second sides;

at least one pair of end baffles each located between said central baffle and each end plate wherein said pair of end plates are symmetrically disposed about said central plane;

said central baffle and said end baffles overlapping to form an acoustically obstructing and reflecting means and non flow restricting path; and said exhaust muffler having a triangular cross section muffler chamber being reversible end for end wherein back pressure is the same in both directions.

2. The exhaust muffler having a triangular cross section muffler chamber of claim 1 wherein;

said triangular muffler chamber has a cross section shape chosen from the group consisting of a right triangle, an isosceles triangle, an equilateral triangle, an obtuse triangle and an acute triangle.

3. The exhaust muffler having a triangular cross section muffler chamber of claim 1 wherein;

the angle between the third side of said triangular cross section muffler chamber and a face of each said end baffle is within the range of 30 to 65 degrees and angles away from its proximate end plate.

4. The exhaust muffler having a triangular cross section muffler chamber of claim 1 wherein;

a second exhaust muffler having a triangular cross section muffler chamber are placed with their third sides coincident to form a compact mated pair of exhaust mufflers having a triangular cross section muffler chamber, useful in a dual exhaust configuration wherein each compact mated pair of exhaust muffler having a triangular cross section muffler chamber is connectable to an individual exhaust manifold.

5. The exhaust muffler having a triangular cross section muffler chamber of claim 1 wherein;

second exhaust muffler having a triangular cross section muffler chamber are placed with their third sides coincident to form a compact mated pair of exhaust mufflers having a triangular cross section muffler chamber, useful in series configuration wherein said compact mated pair of exhaust muffler having a triangular cross section muffler chamber provides increased acoustic attenuation.

6. An exhaust muffler having a triangular cross section muffler chamber wherein;

said exhaust muffler having a triangular cross section muffler chamber consists of:

a triangular cross section muffler chamber having a first, a second and, a third side;

a pair of end plates;

said end plates each interposed with entrance/exhaust ports wherein said entrance/exhaust ports are interchangeable as one of an entrance port and one of an exhaust port;

a central baffle having two surfaces angularly disposed wherein said central baffle is located on a central plane within the triangular cross section muffler chamber and having its base edges coincident with said first and said second sides;

at least one pair of end baffles each located between said central baffle and each end plate wherein said pair of end plates are symmetrically disposed about said central plane;

said central baffle and said end baffles overlapping to form an acoustically obstructing and reflecting means and non flow restricting path;

said entrance/exhaust port has a decorative tail pipe extension at the exhaust port; and said exhaust muffler having a triangular cross section muffler chamber being reversible end for end wherein back pressure is the same in both directions.

7. The exhaust muffler having a triangular cross section muffler chamber of claim 6 wherein;

said triangular muffler chamber has a cross section shape chosen from the group consisting of a right triangle, an isosceles triangle, an equilateral triangle, an obtuse triangle and an acute triangle.

8. The exhaust muffler having a triangular cross section muffler chamber of claim 6 wherein the angle between the third side of said triangular cross section muffler chamber and a face of each said end baffle is within the range of 30 to 65 degrees and angles away from its proximate end plate.

9. The exhaust muffler having a triangular cross section muffler chamber of claim 6 wherein;

a second exhaust muffler having a triangular cross section muffler chamber are placed with their third sides coincident to form a compact mated pair of exhaust mufflers having a triangular cross section muffler chamber, useful in a dual exhaust configuration wherein each compact mated pair of exhaust muffler having a triangular cross section muffler chamber is connectable to an individual exhaust manifold.

10. The exhaust muffler having a triangular cross section muffler chamber of claim 6 wherein;

a second exhaust muffler having a triangular cross section muffler chamber are placed with their third sides coincident to form a compact mated pair of exhaust mufflers having a triangular cross section muffler chamber, useful in series configuration wherein said compact mated pair of exhaust muffler having a triangular cross section muffler chamber provides increased acoustic attenuation.

* * * * *